United States Patent [19]

Riley

[11] 4,107,764

[45] Aug. 15, 1978

[54] LIGHT DISPLAY

[76] Inventor: Bruce G. Riley, 8026 Maple St. Omaha, Nebr. 68134

[21] Appl. No.: 618,490

[22] Filed: Oct. 1, 1975

[51] Int. Cl.[2] ..... A47G 33/16

[52] U.S. Cl. ..... 362/35

[58] Field of Search ..... 240/10.1, 10 R, 2 G; 362/35

[56] References Cited

U.S. PATENT DOCUMENTS

| | | | |
|---|---|---|---|
| 378,126 | 2/1888 | Wright | 240/10.1 X |
| 3,080,474 | 3/1963 | Allen | 240/10.1 |
| 3,536,908 | 10/1970 | Oster | 240/10.1 |
| 3,634,679 | 1/1972 | Krzyston | 240/10.1 |
| 3,755,664 | 8/1973 | Reiback | 240/10.1 X |
| 3,762,082 | 10/1973 | Mincy | 240/10.1 X |
| 3,808,721 | 5/1974 | Gersch | 240/10.1 X |
| 3,949,350 | 4/1976 | Smith | 240/2 G |

*Primary Examiner*—Donald A. Griffin

[57] ABSTRACT

A light display for displaying varying patterns and colors of light randomly appearing on a translucent surface to which the light is directed from the back side from a light source through moving color means and past light ray distorting means comprising prisms, and means for causing the color and prism means to move to deliver a random pattern light display.

9 Claims, 6 Drawing Figures

LIGHT DISPLAY

FIELD OF THE INVENTION

This invention is in the field of light displays for delivering multi-colored patterns of light on translucent screen means.

DESCRIPTION OF THE PRIOR ART

The U.S. Pat. No. 3,538,323 issued to Ziegler is directed to means for shielding the translucent screen for substantially all rays of the projection lamp means, except those rays passing through a vari-colored filter. This has the effect that the shielding causes the lights to throw substantially a spot instead of a general light. I have found that a more general flow of light rays from light source means through vari-colored filtered means gives a more pleasing effect than substantially a spot of light.

There is the desire to disperse substantially all of the vari-colored light beam widely. I have found, however, that revolving lenses which I place in the path of the beam give a better effect if they disperse only some of the light coming from the filters. In fact, I prefer the artistic effect gained when more of the light passes by my lenses than strikes the lenses.

It is not of concern to me that some light may pass by the edges of my filters because some light rays reaching the screen that are not colored, I find also desirable, although an effective and attractive display can be accomplished with or without this feature.

I prefer to use in combination with the light filters and lenses, a light filter that is opaque but has holes in it.

The patent to Mincy U.S. Pat. No. 3,762,082 does have a light filter with holes in it, but one which is stationary; whereas, I have found that a rotating light filter is much more effective.

I have found that rotation of prisms is a simple and inexpensive way to obtain desirable random light patterns, thus gaining in economy over the method used in the U.S. Pat. No. 3,634,679 issued to Krzyston, in which lenses are caused to define planetary movements whereby the total construction is much more expensive than is the case for simple rotation of lenses.

I found it important that the display screen be not hemispherical, but as completely spherical as possible for maximum desired effect, although a portion of the bottom side must be open in order to admit light from the light prisms.

To have the prisms disposed directly in the light screen sphere focuses the rays sharply to give patterns that are not excessively vague and, therefore, have greater interest because of their relative closeness to the screen itself.

I find it desirable that the light filters not be disposed at the mid-point of a spherical screen configuration, but that they be disposed outside of the spherical configuration, directing light up to prisms disposed within the configuration.

There has been a need in the prior art for a new approach to prisms, one in which the prisms can be made with greater economy so that the product can reach a mass market. It is further desirable that the screeen be made from readily available, substantially spherical units which are in cheap mass production availability.

SUMMARY OF THE INVENTION

A varying pattern light display comprising a frame, a light ray distorting means moving in a path, power means mounted on said frame and supporting said distorting means for driving said light distorting means in said path, a display housing mounted on said frame, a substantial portion of said display housing being translucent, said display housing having an opening on one side through which light can enter said display housing, a light source attached to said frame and delivering light through said housing opening and to said distorting means, a light blocking means mounted on said frame between said source and said display means, said light blocking means having a light passage therethrough which permits light from said source means to reach said housing opening, said blocking means blocking substantially all light from said source from reaching said display housing, except that light which passes through said display housing opening, at least the majority of said distorting means being disposed in the path of light rays moving from said source to said display housing. A display with this combination of features is a major objective of this invention.

A particular object is to provide light distorting means in the form of inexpensively made prisms, and to dispose these prisms on the inside of the spherical configuration of the display housing, and to cause them to rotate in simple rotation about an axis for economy, rather than to define expensive and complicated motions.

A further object is to provide a light filter which simply rotates and which is opaque with holes in it, to further distribute the light before it reaches the lenses.

An objective is to make the display screen or housing substantially spherical, rather than merely hemispherical; whereby the random colored light is distributed by the lenses over a wider area and in further combination with the use of mirrors to direct light upwardly into the side so as to pass through an opening in the display housing in a direction for illuminating the lower portions of the substantially spherical display housing, which light would not reach directly from the source without use of the mirrors.

A further object is to dispose all light filters and color discs in an area of the frame which is outside the translucent display housing and preferably below it, and a further object is to surround these parts with a light blocking means, having a light passage communicating with the display housing opening, with the blocking means preventing substantially all light from this source and from the color discs and light filter area from reaching the eye of the viewer on the exterior of the display, except such light as can be seen through the translucent housing.

DESCRIPTION OF THE PREFERRED EMBODIMENTS

Figure 1:
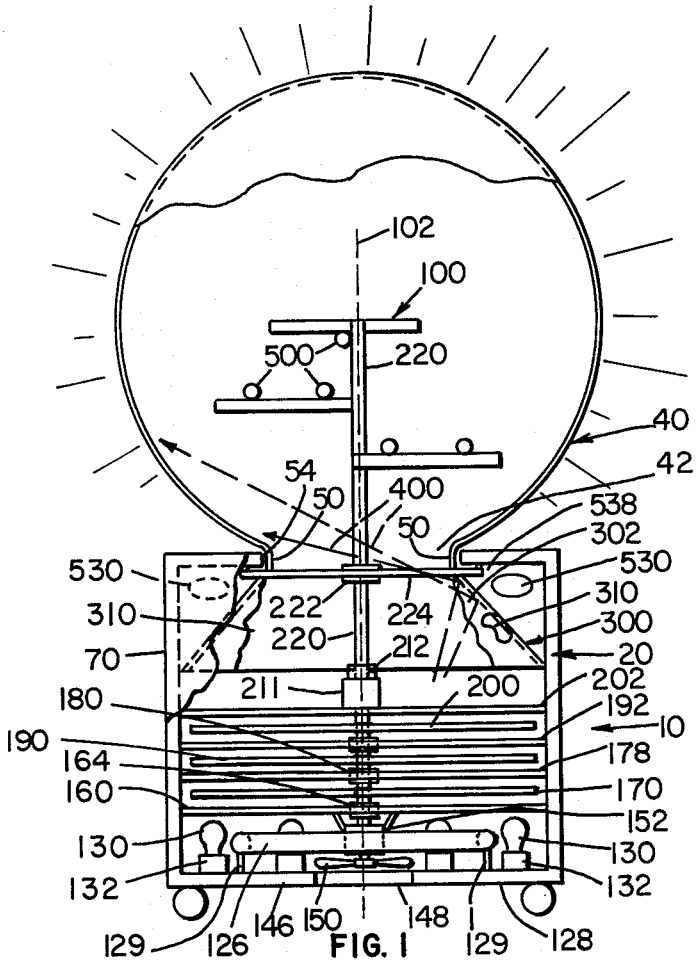
FIG. 1 is a frontal elevation of the display of this invention with a portion of the display housing and a portion of a light blocking cover broken away for showing parts of the interior.

The varying pattern light display of this invention is generally indicated at 10 in FIG. 1 and comprises a frame 20 on the top of which a display housing, generally indicated at 40 is mounted.

The display housing 40 preferably is of generally spherical shape, but having an opening 42 at its lower end, from the sides of which latter the housing extends downwardly into a generally cylindrical collar 50.

The collar 50 is received in a hole 54 in the top of a cover 70, which latter can be, for example, of box-like shape, being almost a cube, although other shapes will work also.

The cover 70 and the frame 20 are almost one and the same, but it is necessary to use the word "cover" so it can be regarded that some parts of the cover 40 can be considered to be the frame 20 and other parts of the cover 70 can be considered to be covering the frame 20 for purposes of distinguishing terminology.

Inside the display housing 40 is a light-ray distorting assembly generally indicated at 100, and the assembly 100 can be considered to move in a path circularly around an axis 102 which is preferably held in a vertical position as shown.

The entire display housing 40 is preferably translucent and it is vital that a substantial portion thereof be translucent. A light source generally indicated at 120 is attached to the frame 20 and the source 120 is preferably in the form of a substantially circular fluorescent bulb 126 which can be seen in FIG. 4. The fluorescent bulb 120 lies in a horizontal plane and is supported above the bottom 128 of the frame by supports 129 and is connected to a source of power, now shown.

In addition to the light source 120, other light sources can be provided such as the plurality of incandescent bulbs 130, best seen in FIG. 1. Bulb 130 is mounted in a socket 132 attached to the frame 20. The cover 70 has a bottom wall 146 having an air passage 148 therethrough so that air can be drawn up into the housing by a fan 150 driven by a motor 152.

The motor 152 is suspended from a thin elongated member or support 160 which latter can be formed of translucent material and which is disposed extending horizontally at a spacing above the fluorescent and incandescent bulbs 120 and 130.

The support 160 is attached to the frame 20 at its ends on brace 160, a color member motor or color wheel motor 164 is mounted with its shaft pointing upwardly and to its shaft a color wheel 170 is attached so that the motor 164 causes it to rotate at a certain first speed, very slowly.

Figure 4:
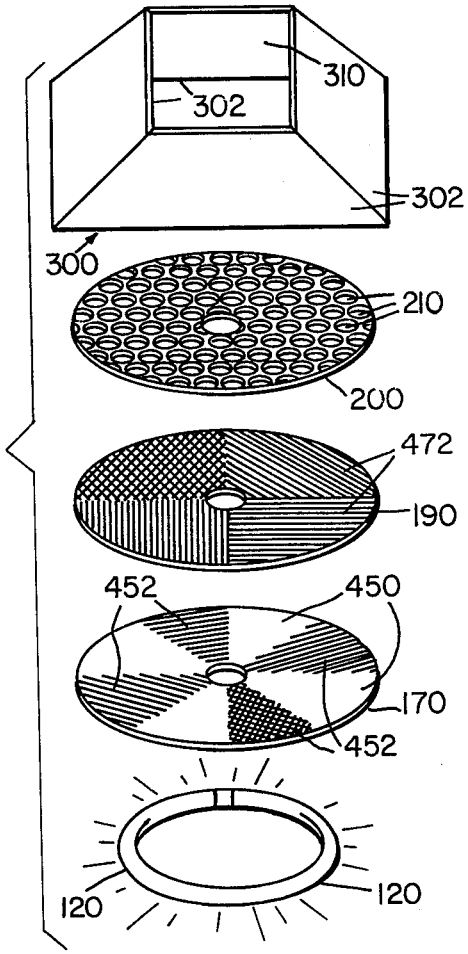
FIG. 4 is a prospective showing only certain parts of the display of FIG. 1 and shown separated apart for ease of illustration.

Above the color wheel 70 a second brace 178 is attached to the frame 20 at its end and the brace 178 is of similiar description and attachment to the brace 160 and the brace 178 supports a second color wheel motor 180 which likewise has its shaft facing upwardly and fixed to and rotating a second color member wheel 190 also seen in FIG. 4.

Above the second color wheel 190 is a third brace 192 which supports a light-filter wheel 200, which latter is also seen in FIG. 4 and which is a disc having circular openings spaced throughout its surface as seen at 210.

Above the filter wheel or disc 200 is a fourth brace 202 fixed to the frame 20, and similarly describable to the other braces in construction and cover attachment, and supporting a light-distorting assembly motor 211 which latter has its drive shaft facing upwardly and attached by a coupler 212 to a translucent post 220 which extends vertically upwardly through the opening 50 and also a substantial distance into the light-display housing 40.

The post 220 is supported in the bearing 222 mounted on the bearing support 224 suitably fixed to the frame 20, the support 224 being translucent.

All of the supports above described and also the post 220 can also be transparent and preferably are transparent rather than merely translucent.

The mirror assembly shown at 300 in FIGS. 1 and 4 comprises the forward and rearward, and right and left, mirrors 302 with their mirroring inner surfaces which latter are arranged in a frustro-pyramidical configuration tapering from more wide spacing at the lower end, substantially of the area of the entire innerside of the rectangular cover 70, inwardly to a smaller upper end action of the configuration of the inner mirror surfaces of the assembly; such configuration at the upper ends of the mirrors extending to a horizontal rectangular upper end closely fitting to and surrounding the circular opening 50 in the display housing 40 so that the mirror assembly 300 functions to direct light coming from therebeneath so that light striking the mirror assembly 300 can reach the lowermost portions of the spherical display housing 40, for example, along the arrow lines 400 of FIG. 1.

In FIG. 4 the choice in the colors in the color wheel 170 and 190 can be of any kind and choices of colors in such matters have varied in the prior art. However, the lower color wheel 170 can have blank spaces 450 alternating with colored spaces for 452 which latter can each be different colors. Likewise in the upper color wheel 190 there can, for example, be four sections 472 each having a different color which latter color will carry on upward to the display housing 40 unmixed with another color at certain times because of the presence of the clear spaces 450 in the lower color wheel.

Figure 3:
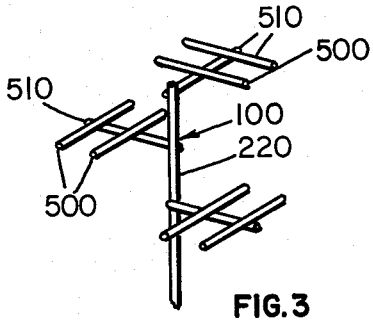
FIG. 3 is a prospective view showing the light distortion assembly of FIG. 1.

In FIG. 1 and FIG. 3 it can be seen that the post 420 supports a plurality of please insert light dispersing members 500, also called light-ray distorting elongated members 500, the members 500 each functioning as a prism for distorting light rays and each preferably being an elongated solid rod of translucent thermoplastic material, the latter material being chosen because of its low cost and because of its ease of being attached to other thermoplastic material.

Prism supports 510 can be attached to the post 220 and each extend radially outwardly therefrom and can also be made of thermoplastic transparent or at least translucent material suitably fixed to the post 220 and to the prism or light-distorting members 500.

The post 220 is preferably formed of transparent material throughout almost all of its entire lenth in order to cast a minimum shadow into the display housing 40.

The prism 500, the supports 510 and the post 220 are all preferably formed of clear transparent material although the display housing itself shown at 40 must be formed of translucent material, not transparent material, so as to form a screen against which the lights are displayed.

Figure 2:
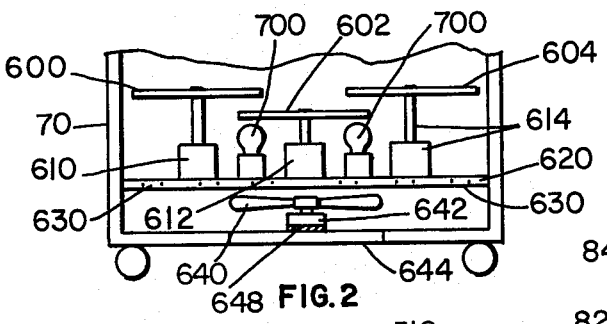
FIG. 2 is a side elevation of a bottom portion of the blocking cover of a modified form of the display with the forward half thereof removed for showing the interior.

Referring to FIG. 2, a modification is there shown in which there are three color wheels, 600, 602, and 604 which latter are driven by motor and shaft assemblies 610, 612, and 614, all supported on a support 620 mounted on the cover 70, the support 620 having many perforations 630 in it of substantial size so that cooling air from a fan 640 driven by a motor 642 can pass through an opening 644 in the bottom of a cover 70 and up through the cover 70 the same way as described for FIG. 1.

The fan motor number 642 can be suported on the cover 70 by a brace 648. Light, in the modification of FIG. 2, comes from bulbs 700 disposed under the color disc 602 which is disposed at the center of the cover 70. The color discs 600 and 604 are disposed above and lapping with portions of the central disc 602 so that light shines through the lower disc 602 and also through the upper discs 600 and 604 at all times. It is desirable that the lower disc 602 be similar to the disc 170 of FIG. 4 in that it has both colored areas and transparent areas for the same reason although the discs 600 and 604 can have alternating areas of different colors.

Figure 5:
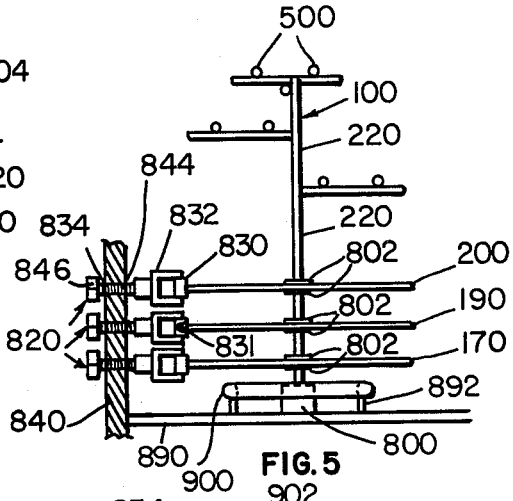
FIG. 5 is a diagrammatic view of a modification of the interior mechanism of the invention shown with a portion of the cover, other parts not being shown.

Referring now to FIG. 5, the modification thereshown is designed so that a single motor 800 drives both the post 220 and the two color discs or wheels 170, 190 and the filter wheel 200, since in FIG. 5 the color discs wheels or 170 and 190 and the wheel 200 are each loosely mounted on the post 220 with their center openings 202 larger than the transverse area of the post 220 so that the wheels 170, 190 and 200 can move independently of the cylindrical post 220.

Each of the color wheels of the modification of FIG. 5 are received between two washers 802, one at the top of each disc and one at the bottom side of each disc with the washers 802, firmly fixed to the post 220 so as to support the discs 170, 190 and 200 from falling downwardly while at the same time letting them rotate freely and differently from the post 220.

As thus described, it will be seen that the mere fact that the discs of FIG. 5 rest on the under washers 802 will cause the discs to be rotated with respect to the frame 20. Without any other mechanism, such as a braking assembly, generally indicated at 820 in FIG. 5, they would all rotate at the same speed as the post 220. However, the braking assemblies 820 are three in number, each adapted to engage, and brake, a different one of the discs 170, 190 and 200.

As thus described, it will be seen that the mere fact that the discs of FIG. 5 rest on the under washers 802 will cause the discs to be rotated with respect to the frame 20. Without any other mechanism, such as a braking assembly, generally indicated at 820 in FIG. 5, they would all rotate at the same speed as the post 220. However, the braking assemblies 820 are three in number, each adapted to engage, and brake, a different one of the discs 170, 190 and 200. Each braking assembly 820 has a disc-engaging roller 830 of cylindrical shape rotating about a vertical axis and axle 831 of a respective roller support 832, supported by a bolt 834.

Each bolt 834 is threadedly extended through a side wall of a modified cover 840, which latter differs from the cover 40 in FIG. 1 only in that it has threaded openings 844 therethrough, each receiving a bolt 34 horizontally therethrough so that a rotation of a knob 846 of a bolt 834 will cause the braking roller 830 of the respective braking assembly 820 to press against its respective disc to an extent proportional to its adjusted position threadedly in the cover 840.

In operation, the modification to FIG. 5 is adapted so that discs 170, 190 and 200 can each be caused to rotate at a different speed from each other for achieving an ideal mixture of colors. Other parts of the modification of FIG. 5 are not shown excepting a brace 890 which is a part of the frame 20 and is attached to the cover 840 and which supports the motor 800 indirectly through legs 892. The brace 890 also supports a fluorescent light bulb 900 disposed below the lowermost disc 170.

Figure 6:
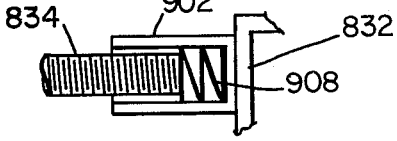
FIG. 6 shows detail of a portion of a braking assembly in vertical cross section taken along the center of a spring supporting sleeve with only closer portions of a bolt and roller support being shown.

FIG. 6 draws a detail of a bolt 834 of FIG. 5 with its inner end slidably received in a sleeve 902, the latter attached to a roller support 832. A coiled compression spring 906 is between the support 832 and the spring 908, so that the position of the respective bolt 834 regulates the pressure of the spring and pressure of the respective roller against a disc.

It can be seen that the discs 170 and 190 can also be called at least two light modifying members disposed lapping each other along a path between the light source 120 and the display housing 40. At least one part of each of the light modifying members or discs 170 and 190 is both translucent and colored, when colored is a term to mean other than clear.

The colored part, for example 452, of one of the light modifying members or discs 170 is of a different color than the colored part, such as one of the parts 472 of the disc 190, of the other light modifying member or disc 190 for the purpose of color blending.

In this sense a mounting and driving means drives the two light modifying members 170 and 190 with respect to the frame and with respect to each other and also mounts them on the frame and causes them to rotate in manners for disposing different parts of the modifying members 170 and 190 adjacent each other and lapping each other at different times so as to blend and vary the color of light leaving that one of the light modifying members which is shown at 190, and which is closest to the display housing, such mounting and driving means in FIG. 1 being the color wheel motors 164 and 180 and their respective braces 160 and 178. The display housing 40 is entirely translucent preferably. As seen in FIG. 1 almost all of the display housing 40 is uncovered, or in other words not covered by the cover 70, whereby the display housing can be said to have a translucent portion which is uncovered so that light rays can pass therethrough horizontally outward to at least one side and preferably all sides, of the translucent display housing 40. The light ray distorting or dispersing assembly 100 can be seen in FIG. 1 to be disposed within those parts of the display housing 40 which are uncovered. The light dispersing assembly 100 can also be seen in FIG. 1 to be disposed more than one-fourth of the distance from that side of the uncovered part of the translucent portion of the housing 40 which is closest to the display housing opening 42 to that upper part of the display housing which is opposite the display housing opening 42.

In the modification of FIG. 2 it can be seen that this same effect of color blending is accomplished in a different way by the different type of overlapping and drive there shown.

Conversely, this same color blending is also accomplished in FIG. 5 modification using the same motor but employing frictional resistance to accomplish the driving at different speeds.

In FIG. 2, the color wheels or discs 602 and 604 can be considered to be light modifying members in the sense of the operation just described.

I claim:

1. A varying pattern light display comprising: a frame, a hollow display housing mounted on said frame, a substantial portion of said display housing being translucent so as to provide a display surface means, said display housing having an opening therethrough on one side through which opening light can enter said display housing, a light source attached to said frame and delivering light into said housing, a light blocking means mounted on said frame between said source and said display surface means, said light blocking means having a light passage therethrough permitting light from said source to reach said housing opening, said blocking means blocking substantially all light from said source from reaching said translucent display housing except that light which passes through said display housing opening, a light dispersing means, said light dispersing means having portions moving in closed pathways transversely across the paths of light rays moving from said source to the inner surface of said display housing, means for driving said light dispersing means comprising an upwardly extending elongated post, means for mounting said post on said frame and for causing said post to rotate about an upwardly extending axis, said light dispersing means portions being disposed in spaced positions with respect to each other and being disposed in positions spaced outwardly from said post in directions transversely of said axis, means attaching each said light dispersing means portion to said post so that said light dispersing means portions each rotate around said axis.

2. The display of claim 1 having said light dispersing means disposed directly in the path of only a minority of the light passing from said source through said passage means to said display surface means to any one moment.

3. The display of claim 1 in which said light dispersing means comprises a plurality of elongated translucent members.

4. The light display of claim 1 in which a plurality of mirrors are mounted on said frame beneath said transparent display housing opening, said mirrors being disposed for receiving light from said light source and directing it transversely of a direct path from said light source to said display housing opening and on into said display housing opening so that lower portions of said display housing receive more illumination because of said mirrors.

5. The light display of claim 1 having at least two rotating light modifying members disposed lapping each other along a path between said light source and said display housing, at least one part of each of said light modifying members being translucent and colored, said at least one colored part of one of said light modifying members being of a different color than a colored part of the other of said light modifying members, and mounting and driving means mounting said two light modifying members on said frame and causing them to rotate in manners for disposing different colored parts of said modifying members adjacent each other and lapping each other as described at different times so as to vary the color of light leaving that one of said light modifying members which is closest to said display housing because of said lapping.

6. The light dislay of claim 1 further having a light filter disposed in the path of light between said light source and said housing, said filter having openings therethrough and also opaque portions, and mounting and driving means mounting said light filter on said housing and causing it to move so as to shift the positions of its openings with respect to said light path.

7. The display of claim 1 having said display housing having a part of its said translucent portion uncovered so that light rays can pass therethrough horizontally outward to at least one side of said translucent portion, said light dispersing means being disposed within those parts of said display housing which are uncovered, said light dispersing means being disposed more than one fourth of the distance from that side of said uncovered part of said translucent portion which is closest to said display housing opening to that part of said display housing which is opposite said display housing opening.

8. The light display of claim 1 having said light dispersing means portions each being elongated, said means attaching said light dispersing means portions to said post extending outwardly transversely of said post.

9. The light display of claim 8 having said means attaching said light dispersing means portions to said post comprising supports extending outwardly from said post and transversely of said axis.

* * * * *